United States Patent [19]

Hengelhaupt

[11] 4,168,127

[45] Sep. 18, 1979

[54] CONSTANT RATE RIBBON WINDING MECHANISM

[75] Inventor: Hans-Georg Hengelhaupt, Nuremberg, Fed. Rep. of Germany

[73] Assignee: Triumph Werke Nürnberg A.G., Nuremberg, Fed. Rep. of Germany

[21] Appl. No.: 842,562

[22] Filed: Oct. 17, 1977

[30] Foreign Application Priority Data

Oct. 21, 1976 [DE] Fed. Rep. of Germany ..... 2647442

[51] Int. Cl.[2] ..... B41J 33/14

[52] U.S. Cl. ..... 400/232; 400/236

[58] Field of Search ..... 400/232, 236

[56] References Cited

U.S. PATENT DOCUMENTS

| | | | |
|---|---|---|---|
| 981,808 | 1/1911 | Steele | 400/232 |
| 981,809 | 1/1911 | Steele | 400/232 X |
| 2,734,614 | 2/1956 | Page | 400/232 X |
| 3,348,650 | 10/1967 | Meinherz et al. | 400/232 X |
| 3,401,783 | 9/1968 | Norwood et al. | 400/232 |
| 3,677,486 | 7/1972 | Findlay | 400/232 X |
| 3,834,511 | 9/1974 | Hengelhaupt | 400/232 X |
| 3,923,141 | 12/1975 | Hengelhaupt | 400/232 X |

*Primary Examiner*—Ernest T. Wright, Jr.
*Attorney, Agent, or Firm*—Brian L. Ribando

[57] ABSTRACT

A mechanism for winding a ribbon on a take-up spool effects a constant winding rate as the diameter of the wound ribbon on the spool increases. A wrap spring intermittently drives a gear which rotates the spool in a stepwise fashion, the free end of the wrap spring being reciprocated by the stroke of an actuating arm. The amount of ribbon which is wound on the spool is sensed by a diameter sensor, which sensor controls the point on the free end of the wrap spring which is contacted by the actuating arm.

3 Claims, 3 Drawing Figures

Fig_1
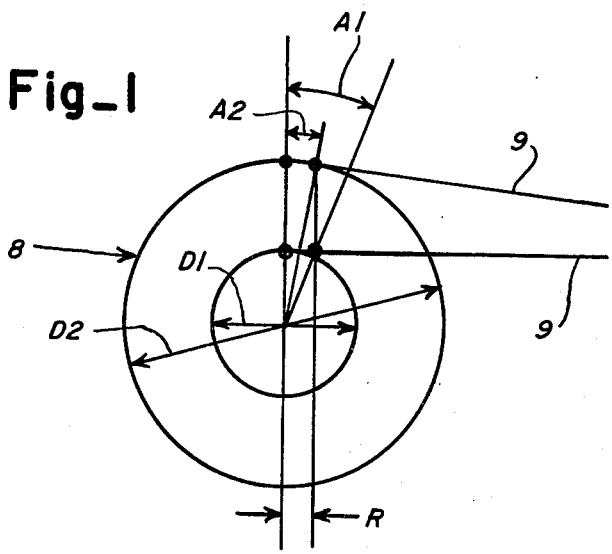
Fig_2
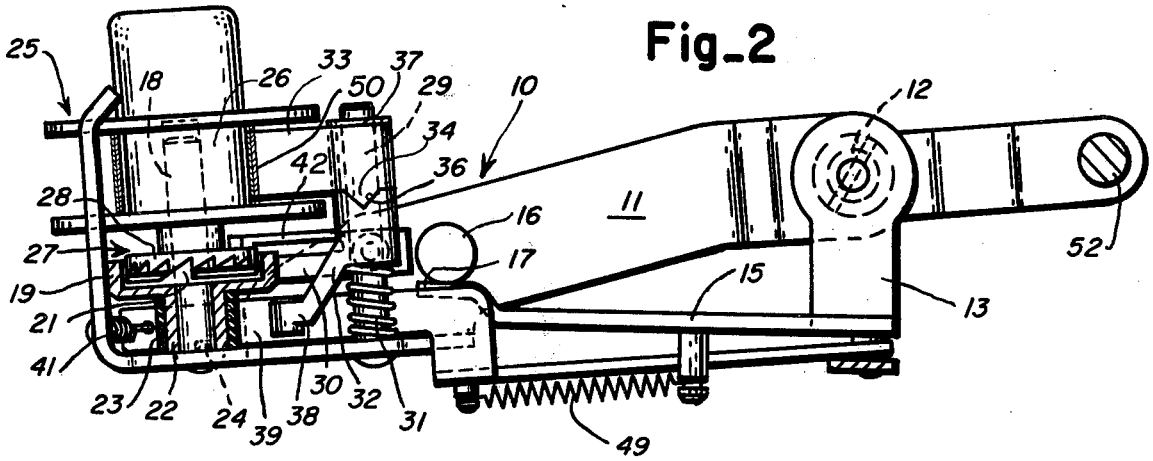
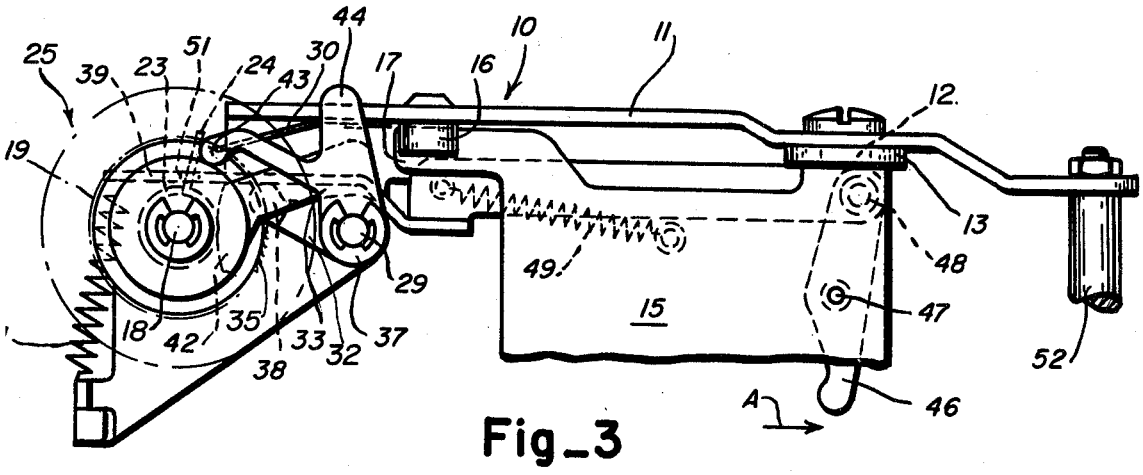
Fig_3

CONSTANT RATE RIBBON WINDING MECHANISM

BACKGROUND OF THE INVENTION

The invention relates to a mechanism for winding a ribbon on a spool, and more particularly, to a mechanism for effecting a constant ribbon winding rate although the diameter of the spool increases as the ribbon is wound thereon.

It is important that the winding rate of a ribbon upon a spool remain constant as the diameter of the spool increases with the ribbon being wound thereon. Such mechanisms are needed, for instance, in office machines for the transport of carbon ribbons or correction ribbons. In order to realize the optimum utilization of such ribbons, impressions which are made upon the ribbons must be closely and uniformly spaced. The impressions must not intersect one another, and the spacing between the impressions must not increase as the diameter of the ribbon which is wound upon a take-up spool increases. One mechanism for the transport of a take-up spool employs the use of wrap springs and is shown in German Disclosure No. DT-OS 23 37 191. The patent to Hengelhaupt, U.S. Pat. No. 3,923,141, discloses a mechanism for providing a constant feed rate increment for a ribbon. In this assembly, a transport roller drives the periphery of a flange on a ribbon take-up spool, and means are provided for decreasing the angle of rotation of the transport roller as the diameter of the wound ribbon on the take-up spool increases.

SUMMARY AND OBJECTS OF THE INVENTION

A transport mechanism winds a ribbon on a take-up spool in a manner which effects a constant winding rate as the diameter of the wound ribbon on the spool increases. A wrap spring is mounted on a gear and drives the gear which in turn rotates a take-up spool in a stepwise fashion. The free end of the wrap spring is reciprocated by the stroke of an actuating arm which is a part of the mechanism, and the amount of ribbon which is wound upon the spool is sensed by a diameter sensor. The amount of rotation of the spool in response to the motion of the actuating arm is dependent upon the point of contact of the actuating arm on the free end of the wrap spring. The diameter sensor regulates the point of contact on the free end of the wrap spring by the actuating arm.

It is, therefore, an object of the invention to provide a constant rate ribbon winding mechanism.

It is a further object of the invention to provide a constant rate ribbon winding mechanism in which the diameter of the ribbon wound on a spool is sensed to control the speed of rotation of the spool.

It is another object of the invention to provide a constant rate ribbon winding mechanism in which the increasing diameter of ribbon wound on a spool is sensed by a diameter sensor to control the application of drive imparted from an actuating arm to a wrap spring which drives the spool.

These and other objects of the invention will become apparent from the following detailed description taken in connection with the accompanying drawing figures in which like reference numerals designate like or corresponding parts throughout the figures.

BRIEF DESCRIPTION OF THE DRAWING

FIG. 1 is a schematic view of a wind-up spool according to the invention;

FIG. 2 is a side elevation of the mechanism of the invention; and

FIG. 3 is a top view of the mechanism shown in FIG. 2.

DESCRIPTION OF THE PREFERRED EMBODIMENT

Referring now to the drawing, there is shown schematically in FIG. 1, a ribbon spool generally designated by reference numeral 8. The diameter of ribbon wound on the spool 8 increases from a first diameter D1 to a second larger diameter D2. Also schematically indicated is a control arm 9 which, in a first position, is tangent to the diameter D1 and, in a second position, is tangent to the diameter D2. In each instance, the actuating arm 9 is stroked through a distance R by a suitable mechanism. Motion of the actuating arm 9 through the distance R, when the arm 9 is tangent to the D1 diameter of the take-up spool 8, causes a rotation of the take-up spool 8 through an angle A1. Motion of the actuating arm 9 through the same distance R, when the actuating arm 9 is tangent to the take-up spool 8 at the diameter D2, causes a rotation of the spool 8 through an angle A2. It will be seen that the angle A2 is much less than the angle A1, but that distance R, measured along the tangent to the diameters D1 and D2, is equal, causing equal amounts of ribbon to be taken up by the spool 8 in the two instances.

Turning now to FIGS. 2 and 3, the mechanism indicated generally at 10 comprises a support 11 which is mounted by a pivot pin 12 to an upstanding lug 13 which comprises a portion of a frame member 15. The lowermost position to which the support 11 may pivot is determined by the contact of a downstop 16 on a frame portion 17. A first upstanding pin 18 is secured to the pivoted support 11 and a driving gear 19 is rotatably mounted thereon. The driving gear 19 includes one or more driving gear teeth 21 and a hub 22. Around the hub 22 is a wrap spring 23 having a free end 24. A ribbon take-up spool 25 is mounted upon the upper portion of the first upstanding pin 18. A take-up spool 25 includes a ribbon winding section 26, shown having ribbon 50 thereon, and a lower spool part 27. The lower spool part 27 includes a gear 28 which is engageable with the one or more driving gear teeth 21 of the driving gear 19. The outer circumferential surface of the driving gear 19 is formed with teeth (only a portion 35 of which are shown for the purposes of clarity) which are engaged by a no back pawl 30. The pawl 30 allows the gear 19 to rotate in one direction only and assists the one way drive imparted to the driving gear 19 by the wrap spring 23.

A second upstanding pin 29 is secured to the pivoted support 11 and receives a compression spring 31, a control lever 32, and a diameter sensor 33. The diameter sensor 33 includes a detent 34 which mates with a groove 36 formed on the upper surface of the control lever 32 to form a coupling therebetween. The action of the compression spring 31 and of a retaining circlip 37 attached to the top of pin 29 maintains the detent 34 in a mating condition with the groove 36 causing the control lever 32 and the diameter sensor 33 to rotate on the pin 29 as a unit but allowing these two elements 32 and 33 to rotate independently of one another when required. The control lever 32 comprises a pusher arm 38 which bears against an actuating arm 39. The actuating arm 39 is biased against the pusher arm 38 by a tension spring 41. The control lever 32 also comprises a spool depressor 42. The spool depressor 42 engages the upper surface of the spool part 27 and maintains the gear 28 in contact with the one or more driving gear teeth 21.

The diameter sensor 33 comprises a nose portion 43 which senses the diameter of wound ribbon 50 on the winding section 26. The diameter sensor 33 further comprises a lever 44, which lever 44 is effective to rotate the nose portion 43 out of engagement with ribbon 50 wound on the spool 25 and to rotate the spool depressor 42 out of engagement with the spool part 27. The actuating arm 39 is reciprocated by a pivoting lever 46 which is mounted to the frame 15 by a pivot pin 47 and which is periodically urged in the direction of the arrow A. The lever 46 and actuating arm 39 are pivotally connected to one another by means of a pin 48. A tension spring 49 maintains the actuating arm 39 biased in opposition to the periodic force imparted thereto by the lever 46. The actuating arm 39 includes an aperture 51 through which the free end 24 of the wrap spring 23 passes. A connecting rod 52 comprises a means for connecting a supply spool and support, not shown, to the take-up spool 25 and the mechanism associated therewith.

The operation of the device will be apparent to those skilled in the art. The pivoting lever 46 is periodically shifted in the direction of the arrow A to cause the actuating arm 39 to be shifted in the opposite direction. The aperture 51, through which the free end 24 of the wrap spring 23 passes, is moved in a counterclockwise direction as viewed in FIG. 3. This counterclockwise rotation causes a like rotation in the driving gear 19 and the teeth 21 thereof drive the driven gear 28 of the take-up spool 25. The driving gear 19 is prevented from rotating in a clockwise direction as the actuating arm 39 is returned to a rest position by the spring 49 by the action of the no back pawl 30. As explained above, the increment of ribbon 50 which is wound by the rotation of the spool 25 is determined by the arc through which the free end 24 of the wrap spring 23 is rotated and by the diameter of wound ribbon 50 on the ribbon winding section 26. As an increasing amount of ribbon 50 is wound upon the section 26, the nose 43 of the diameter sensor 33 is moved outwardly from the center of the spool 25. The detent 34 and groove 36 connection between the diameter sensor 33 and the control lever 32 causes a similar rotation of the control lever 32, which rotation is transmitted to the actuating arm 39 by means of the control lever 32. The motion of the actuating arm 39 away from the center of rotation of the spool 25 shifts the point of force application of the actuating arm 39 on the free end 24 of the wrap spring 23. As the actuating arm 39 is urged further from upstanding pin 18 by the pusher arm 38, the amount of rotation which is imparted to the wrap spring 23 and to the driving gear 19 for a given stroke of the actuating arm 39 is diminished. When it is desired to remove the take-up spool 25 from the mechanism, the nose portion 43 may be withdrawn from the ribbon winding section 26 and the spool depressor 42 may be removed from contact with the spool part 27 by a clockwise rotation of the diameter sensor 33. This rotation is easily effected by means of the lever 44 formed on the diameter sensor 33. Thus, it will be seen that an effective mechanism is provided for insuring that the amount of ribbon 50 which is taken up by a take-up spool 25 remains constant, although the diameter of the wound ribbon 50 on the take-up spool 25 is continually increasing.

I claim:

1. A mechanism for winding a ribbon on a take-up spool in response to a series of equal motion impulses comprising:

a driving member, a driven surface engageable with said driving member and attached to said take-up spool, a wrap spring positioned on said driving member, said wrap spring having a free end extending radially therefrom, an actuating arm for supplying said equal motion impulses to said free end, a passage in said actuating arm for said free end, a diameter sensor responsive to the diameter of ribbon wound on said take-up spool, and a lever responsive to said diameter sensor for selectively positioning said actuating arm along the radial extent of said free end.

2. The mechanism of claim 1 further comprising:

a depressor for urging said driven surface into contact with said driving member, a coupling between said diameter sensor and said lever, and a spring biasing said actuating arm to said lever, wherein said diameter sensor, responsive to the accumulation of ribbon on said take-up spool, causes said lever to pivot against the biasing of said spring.

3. The mechanism of claim 2 further comprising:

a first pin, said first pin providing a mounting for said driving member, said driven surface, and said take-up spool, and a second pin, said second pin providing a mounting for said lever and said diameter sensor.

* * * * *